US009764932B2

(12) United States Patent
Huang et al.

(10) Patent No.: US 9,764,932 B2
(45) Date of Patent: Sep. 19, 2017

(54) JACKING TOWER INSTALLATION SYSTEM

(71) Applicant: Paceco Corp., Hayward, CA (US)

(72) Inventors: Sun Huang, Fremont, CA (US); Sai Kit Cheung, San Mateo, CA (US); Philip Tam, Oakland, CA (US); Kok Leong Wun, Fremont, CA (US); Nathaniel John Newsom, Oakland, CA (US)

(73) Assignee: Paceco Corp., Hayward, CA (US)

( * ) Notice: Subject to any disclaimer, the term of this patent is extended or adjusted under 35 U.S.C. 154(b) by 790 days.

(21) Appl. No.: 14/275,648

(22) Filed: May 12, 2014

(65) Prior Publication Data

US 2014/0332486 A1 Nov. 13, 2014

Related U.S. Application Data

(60) Provisional application No. 61/822,152, filed on May 10, 2013.

(51) Int. Cl.
*B66C 5/02* (2006.01)
*B66C 19/00* (2006.01)

(52) U.S. Cl.
CPC ..... *B66C 19/002* (2013.01); *Y10T 29/49826* (2015.01)

(58) Field of Classification Search
CPC ..... B66C 19/002; Y10T 29/49826
USPC ..... 52/745.18; 212/176; 29/428
See application file for complete search history.

(56) References Cited

U.S. PATENT DOCUMENTS

| | | | | |
|---|---|---|---|---|
| 1,380,591 | A * | 6/1921 | Quet | B66C 23/26 212/176 |
| 3,302,801 | A * | 2/1967 | Poroli | B66C 19/02 212/176 |
| 3,878,662 | A * | 4/1975 | Cernosek | E02L 317/00 52/169.9 |
| 4,028,792 | A * | 6/1977 | Tax | B66C 23/283 254/89 H |
| 4,094,162 | A | 6/1978 | Allee | |
| 5,305,574 | A | 4/1994 | Fedock | |
| 9,032,689 | B2 | 5/2015 | Yustus | |
| 9,222,277 | B2 | 12/2015 | Yustus | |
| 2011/0017693 | A1* | 1/2011 | Thomas | B66C 13/16 212/270 |
| 2011/0309601 | A1* | 12/2011 | Darling, III | A61G 1/013 280/657 |

(Continued)

FOREIGN PATENT DOCUMENTS

| | | | | |
|---|---|---|---|---|
| DE | 2911938 | A1 * | 10/1980 | B66C 19/002 |
| DE | 19722540 | A1 * | 12/1998 | B66C 5/08 |

(Continued)

*Primary Examiner* — Jeanette E Chapman
(74) *Attorney, Agent, or Firm* — Brian Beverly; Beeson Skinner Beverly, LLP

(57) ABSTRACT

A jacking tower installation system comprises a jacking tower having at least two forward and at least two rear legs, wherein each of the legs is supported on one of a plurality of support stands attached to and horizontally offset from the leg, the legs including dollies which enable horizontal movement of the jacking tower and lifts capable of raising and lowering the jacking tower clear of the sill beams of a cargo container crane, such that the legs of the jacking tower can be lifted and positioned over and lowered onto the sill beams.

15 Claims, 9 Drawing Sheets

(56) References Cited

U.S. PATENT DOCUMENTS

| | | | | |
|---|---|---|---|---|
| 2013/0180185 | A1* | 7/2013 | Ferrari | E21B 15/00 52/117 |
| 2014/0259985 | A1* | 9/2014 | Petrello | E04H 12/344 52/115 |
| 2014/0260076 | A1* | 9/2014 | Yustus | E04H 12/344 52/745.18 |

FOREIGN PATENT DOCUMENTS

| | | | | |
|---|---|---|---|---|
| DE | WO-2011054856 | A1 * | 5/2011 | B65G 3/004 |
| JP | WO-9928230 | A1 * | 6/1999 | B66C 13/06 |

* cited by examiner

JACKING TOWER INSTALLATION SYSTEM

CROSS-REFERENCE TO RELATED APPLICATIONS

This application claims the benefit of U.S. Provisional Application No. 61/822,152, filed May 10, 2013.

BACKGROUND OF THE INVENTION

Field of the Invention

The invention relates to devices for raising cargo container handling cranes and particularly to a system for installation of a jacking tower on a cargo container handling crane for lifting portions of the crane to facilitate increasing the height of the crane.

Description of Related Art

Jacking towers are used to modify cranes, in particular to lift separated portions of a crane in order to facilitate crane raise modifications. A jacking tower must be installed on the sill beams of the crane in order to lift a separated upper portion of the crane to permanently increase the height of a crane. Jacking towers are typically large and heavy. Therefore, a method of efficiently moving a partially or fully assembled jacking tower on and off the crane is desirable to reduce job time and expense.

FIG. 1 shows a typical situation where a jacking tower 12 is in position for being moved onto a container crane 4. To install a fully assembled jacking tower onto a crane, the jacking tower must be lifted over and lowered onto the sill beams 6 of the crane 4. Traditionally, this is accomplished by using dedicated lifting cranes, which are expensive to procure and operate. Alternatively, jacking towers can be assembled directly on the crane, but this is time-consuming and requires that the crane be taken out of service for an extended time.

The jacking tower installation system described below provides a simple, fast, and cost-effective system and method for installing and uninstalling jacking towers on cargo container cranes to facilitate crane raise operations.

SUMMARY OF THE INVENTION

A jacking tower installation system according to the invention provides a jacking tower framework having forward and rear legs. The legs are supported by a plurality of support stands each of which is attached to and horizontally offset from one of the legs with a support bracket. The support stands thus support the legs of the jacking tower from positions later to the vertical center lines of the legs. Each of the support stands includes a dolly such that the jacking crane can be moved along a work surface, and a lift that permits the legs of the jacking tower to be raised and lowered. Thus, when its legs are supported by the support stands, the jacking tower can be raised above the level of one of the sill beams of a container crane, moved in position above the sill beam without using a separate crane, and lowered onto the sill beam. The system can be implemented in reverse to remove the jacking tower from the container crane.

BRIEF DESCRIPTION OF THE ILLUSTRATIONS

DETAILED DESCRIPTION OF THE ILLUSTRATED EMBODIMENT

Figure 1:
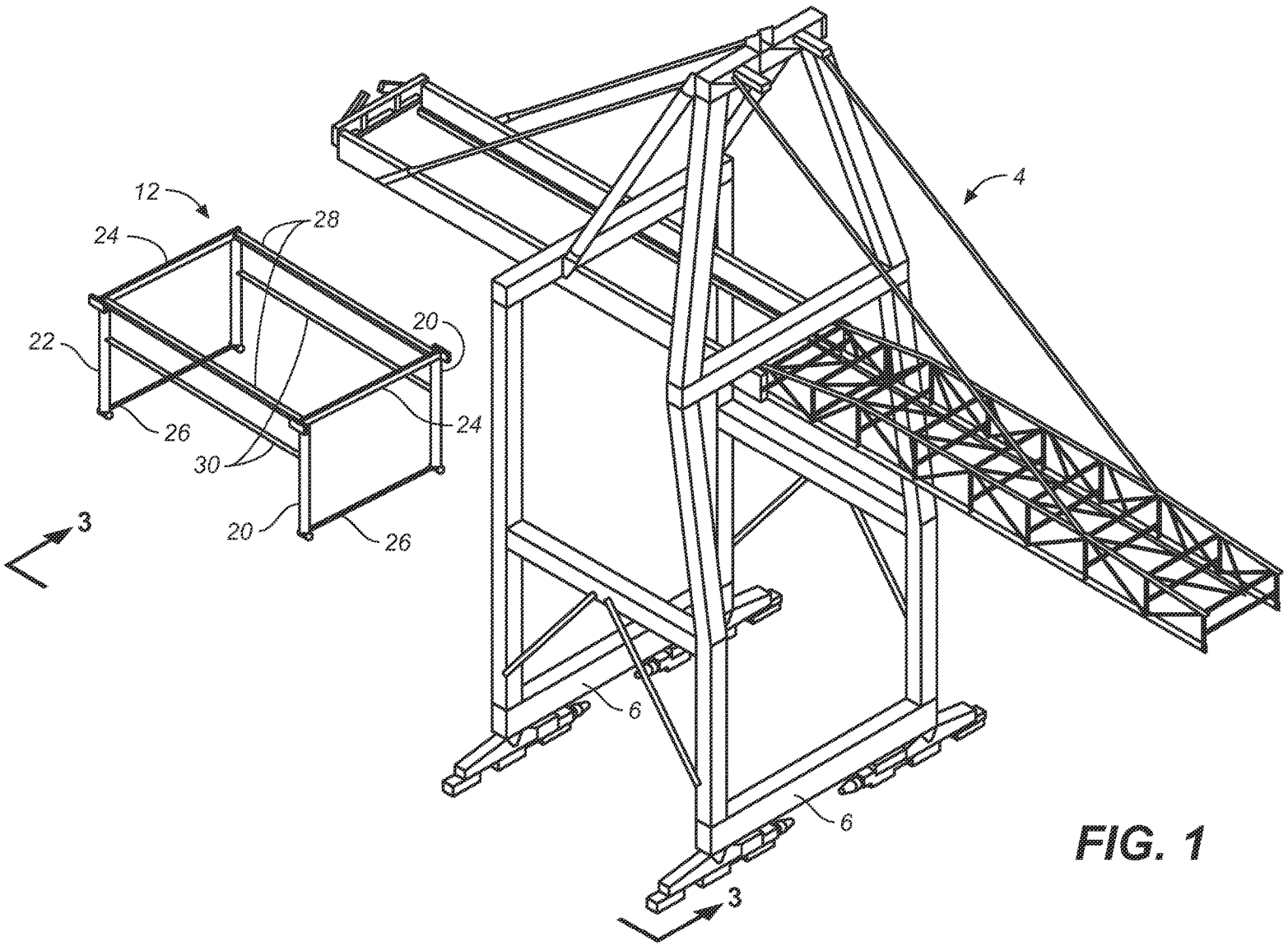
FIG. 1 is an upper perspective view of a cargo container handling crane and a jacking tower.
Figure 2A:
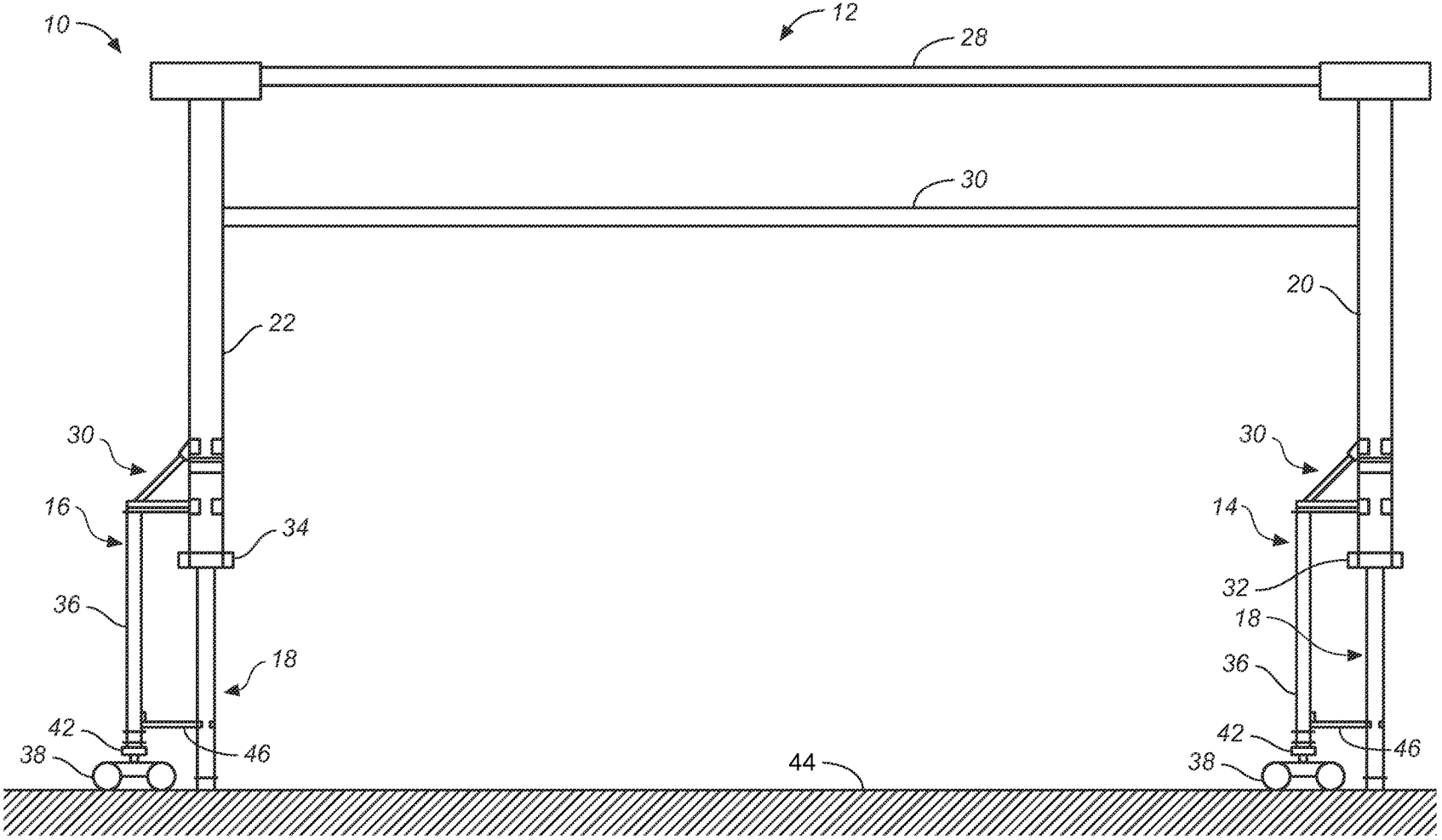
FIG. 2A is a close-up elevation view of the components of jacking tower installation system according to the invention.
Figure 2B:
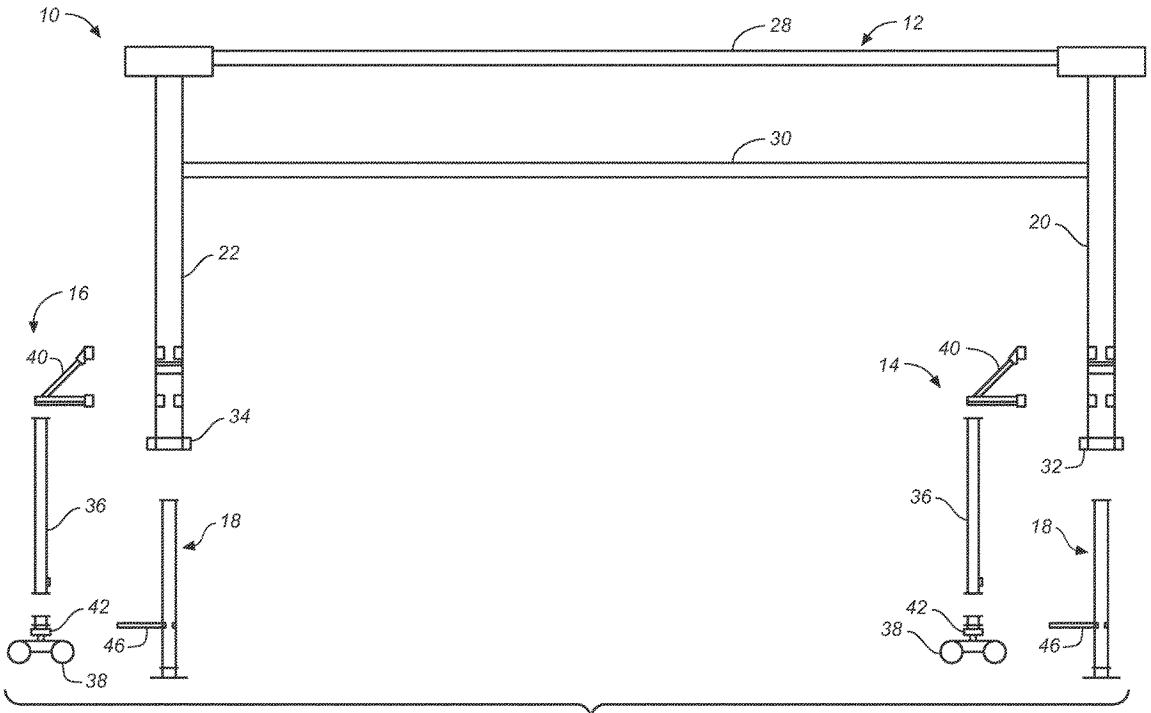
FIG. 2B is an exploded elevation view of the jacking tower system shown in FIG. 2A.

A jacking tower installation system is referred to generally at numeral 10 in FIGS. 2A and 2B, and comprises a jacking tower 12, a plurality of detachable support stands 14, 16, and a plurality of temporary free-standing supports 18. With reference also to FIG. 1, the jacking tower 12 has two forward legs 20 and two rear legs 22. The forward legs 20 are interconnected at their upper ends by laterally-extending top beams 24 and at their lower ends by laterally-extending bottom beams 26. The forward legs 20 are interconnected to the rear legs 22 by primary beams 28 and stabilizer beams 30.

The bottom end of each of the forward legs 20 terminates in a forward footing 32 and the bottom end of each of the rear legs terminates in a rear footing 34. Each of the forward legs 20 is supported by a detachable forward support stand 14 and each of the rear support stands is supported by a detachable rear support stand 16. Each of the support stands 14, 16 includes a support column 36 which is supported on a wheeled dolly 38. The columns can be pipe columns, box columns, or any other construction capable of supporting its proportionate share of the jacking tower. The dollies 38 may be any devices that allow horizontal movement over the ground surface. An offset bracket 40 at the top of each column 36 is attached to the adjoining leg 20, 22 so that the support column 36 and dolly 38 of each support stand 14, 16 is horizontally offset from the leg 20, 22 to which it is attached. Each of the support stands 14, 16 incorporates a lift 42. It is anticipated that the lift will usually comprise hydraulic pistons, but any lift capable of lifting the weight supported by the leg 14, 16 could be used. The support stands can be permanently joined or temporarily attached to the legs as desired and may be affixed to the jacking tower's legs by bolting or other suitable fastening means.

The support stands 14, 16 support the jacking tower on a ground surface 44; the lifts 44 are capable of raising and lowering the jacking tower 12, and any attached support stands 14, 16; and the dollies 38 enable the jacking tower 12 to be moved independently along the ground surface 44.

In the illustrated embodiment, the jacking tower 12 has four legs 20, 22, each of which is supported by a support stand 14, 16 having a support column 36 supported on a dolly 38, and an offset bracket 40 for attaching the column to one of the legs. Those of skill in the art will recognize, however, that there may be any number of such parts depending on the jacking tower configuration and the required load capacity.

With continuing reference to FIGS. 2A and 2B, the jacking tower installation system includes free-standing temporary supports 18 for temporary support of the legs 20, 22 of the jacking tower 12. Each support 18 may be detachably secured to the lower part of the column 36 of an adjoining support stand 14, 16 with a horizontal stabilizing brace 46.

The jacking tower 12 is readied for use by supporting the legs 20, 22 on the temporary supports 18 as shown in FIG. 2A. Support stands 14, 16 are then attached on the sides of the legs 20, 22 oriented away from the crane.

FIGS. 3A-3J show the process for installing a jacking tower onto a crane according to the invention.

Figure 3A:
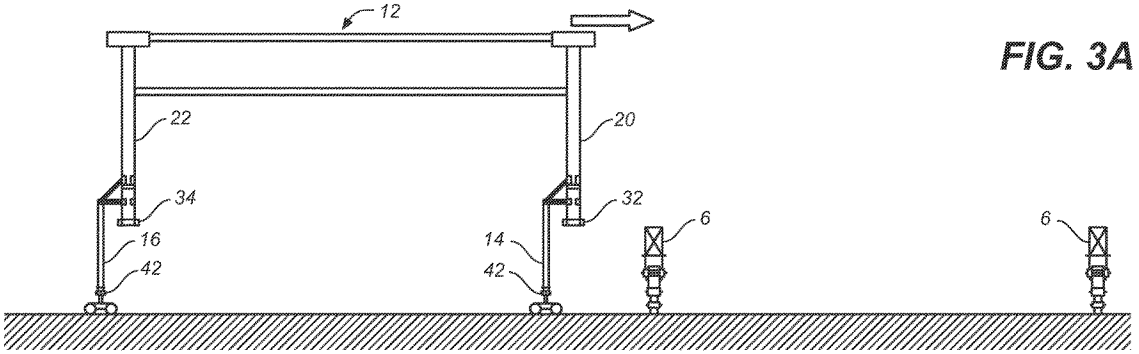
FIG. 3A is a side elevation view of a jacking tower posed adjacent the sill beams and trollies of a container cargo crane.

Referring initially to FIG. 3A, once the support stands 14, 16 are attached to the jacking tower's legs 20, 22, the temporary supports 18 are removed as shown. In preparation for moving the jacking tower 12 over the sill beams 6 of the crane 4, the lifts 42 of the support stands 14, 16 raise the jacking tower 12 until the footings 32, 34 of legs 20, 22 clear the sill beams 6.

Figure 3B:
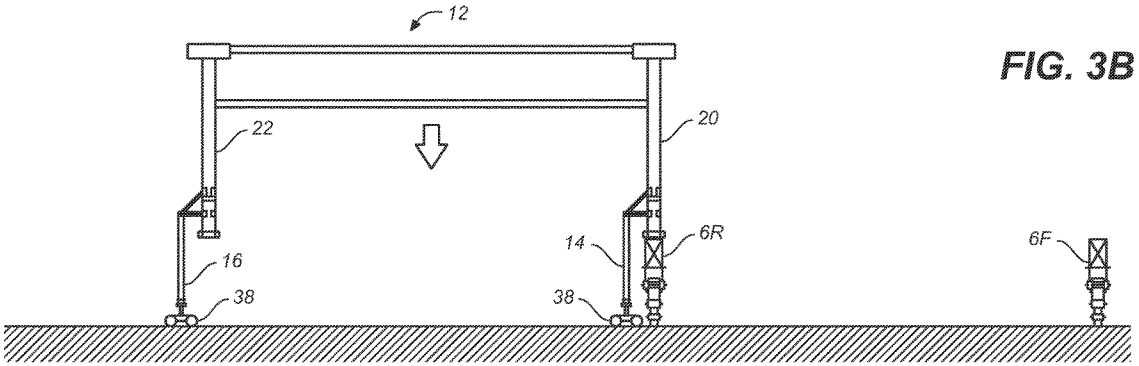
FIG. 3B is a side elevation view taken along line 3-3 of FIG. 1 showing the forward legs of the jacking tower positioned over the rear sill beam of the crane.

The jacking tower 12 is then moved horizontally on the dollies 38 until the forward legs 20 are positioned over and vertically aligned with the rear sill beam 6R of the crane as shown in FIG. 3B.

Figure 3C:
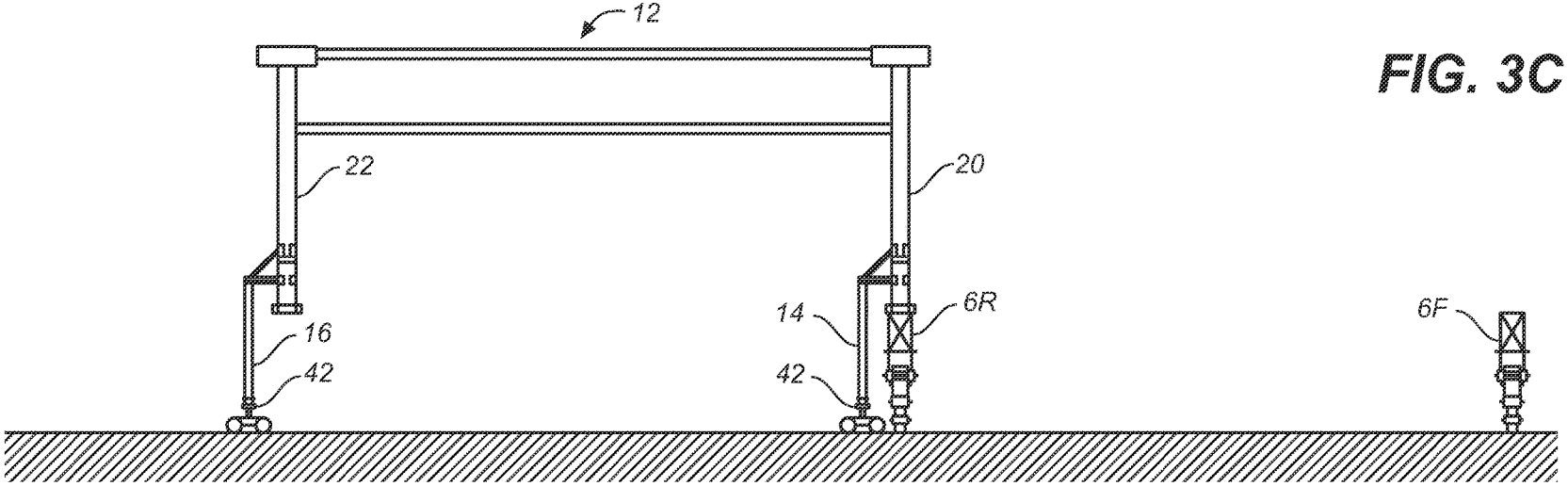
FIG. 3C is a side elevation view showing the legs of the jacking tower lowered until the forward legs thereof are supported on rear sill beam of the crane.

The jacking tower 12 is then lowered by lifts 42 until the forward legs 20 come to rest on the rear sill beam 6R as seen in FIG. 3C. In this position the jacking tower may be temporarily secured to the sill beam.

Figure 3D:
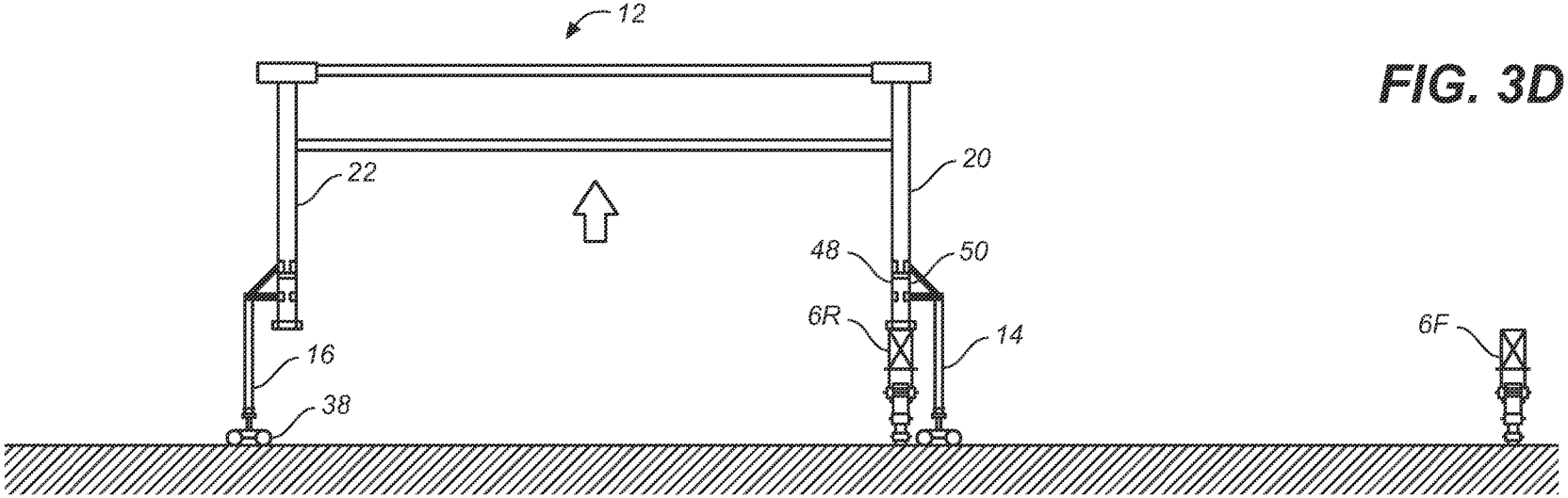
FIG. 3D is a side elevation view showing that support stands have been moved from the inner sides to the outer sides of the forward legs of the jacking tower.

The forward support stands 14 are then detached from the inner side 48 of the forward legs 20, as seen in FIG. 3C, and attached to the outer side 50 of the forward legs 20 as seen in FIG. 3D. If necessary, the legs are detached from the sill beam.

Figure 3E:
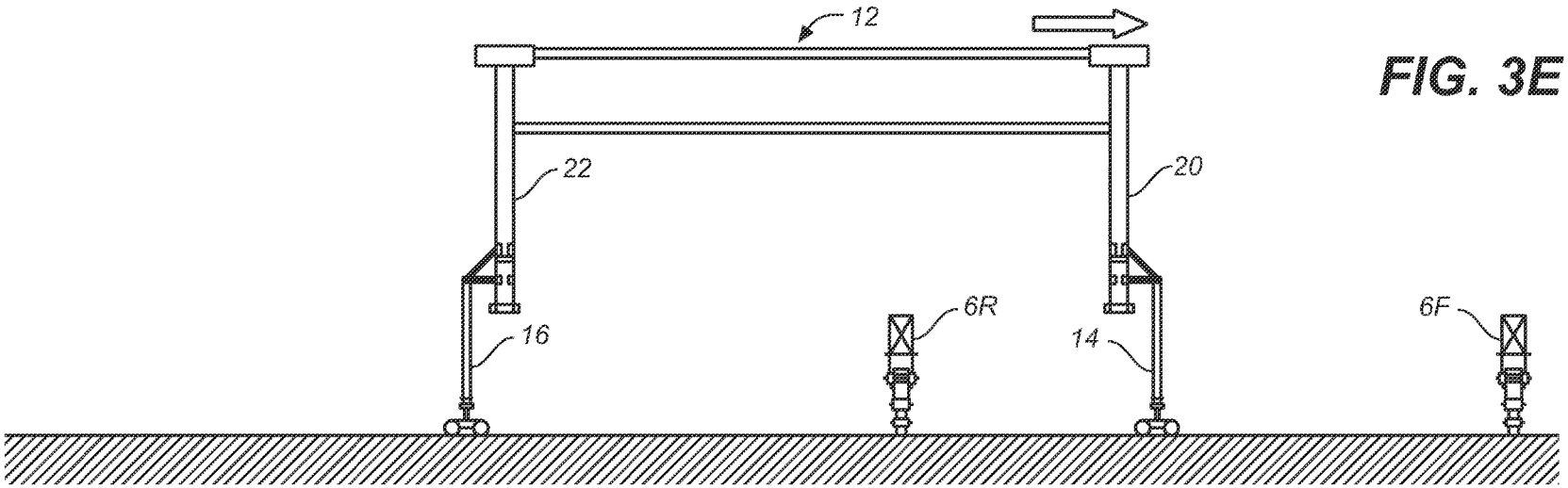
FIG. 3E is a side elevation view showing that the legs of the jacking tower have been raised above the level of the sill beam and that the jacking tower has been moved to a reconfiguration position.

The jacking tower 12 is then lifted above the sill beams and moved horizontally clear of the sill beams to a position in which the forward legs 20 are located between the rear and forward sill beams 6R, 6F as shown in FIG. 3E.

Figure 3F:
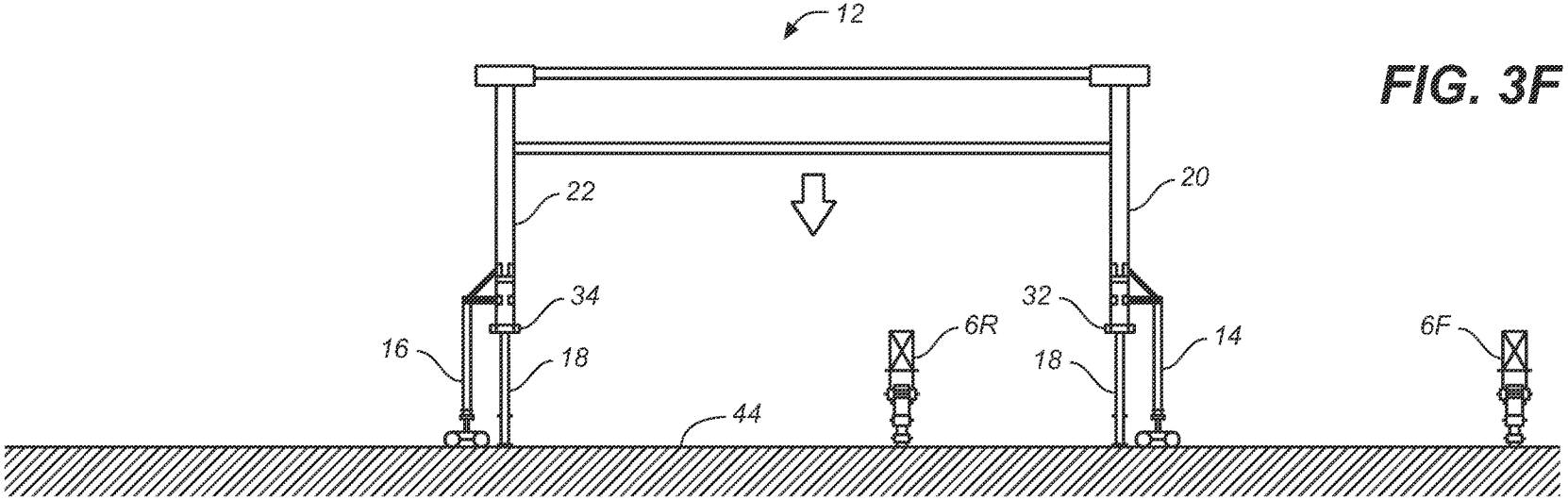
FIG. 3F is a side elevation view showing the legs of the jacking tower lowered onto free-standing supports.

Temporary free-standing supports 18 are then affixed to the footings 32, 34 of the legs 20, 22 and the jacking tower 12 is lowered by lifts 42 until the temporary supports 18 are brought to rest on the ground surface as shown in FIG. 3F. In the illustrated embodiment, each leg 20, 22 of the jacking tower is thereby supported by one of the temporary supports 18. However, it should be understood that only the front legs 20 need be supported by temporary supports 18 at this stage of the process in order to enable reconfiguration of the forward support stands 14 discussed next.

Figure 3G:
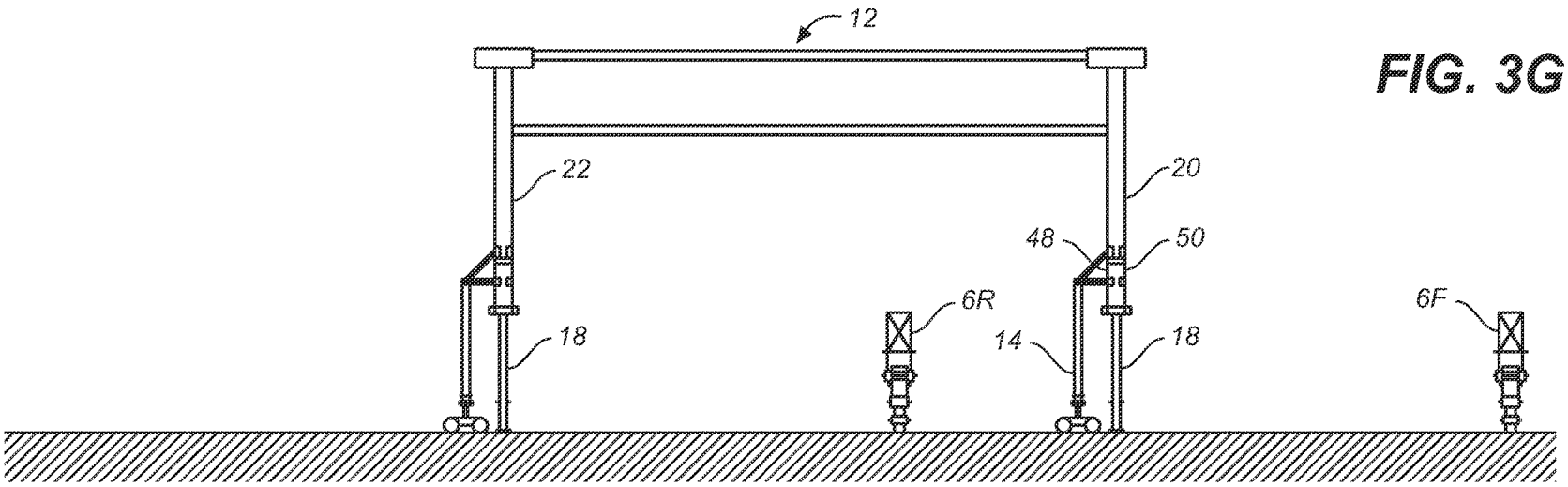
FIG. 3G is a side elevation view showing that support stands have been moved from the outer sides to inner the sides of the forward legs of the jacking tower.

Once the forward legs 20 of the jacking tower 12 are supported on temporary supports 18 as seen in FIG. 3F, the forward support stands 14 are removed from the outer side 50 of the forward legs 20 and reattached to the inner side 48 of the forward legs 20 as shown in FIG. 3G.

Figure 3H:
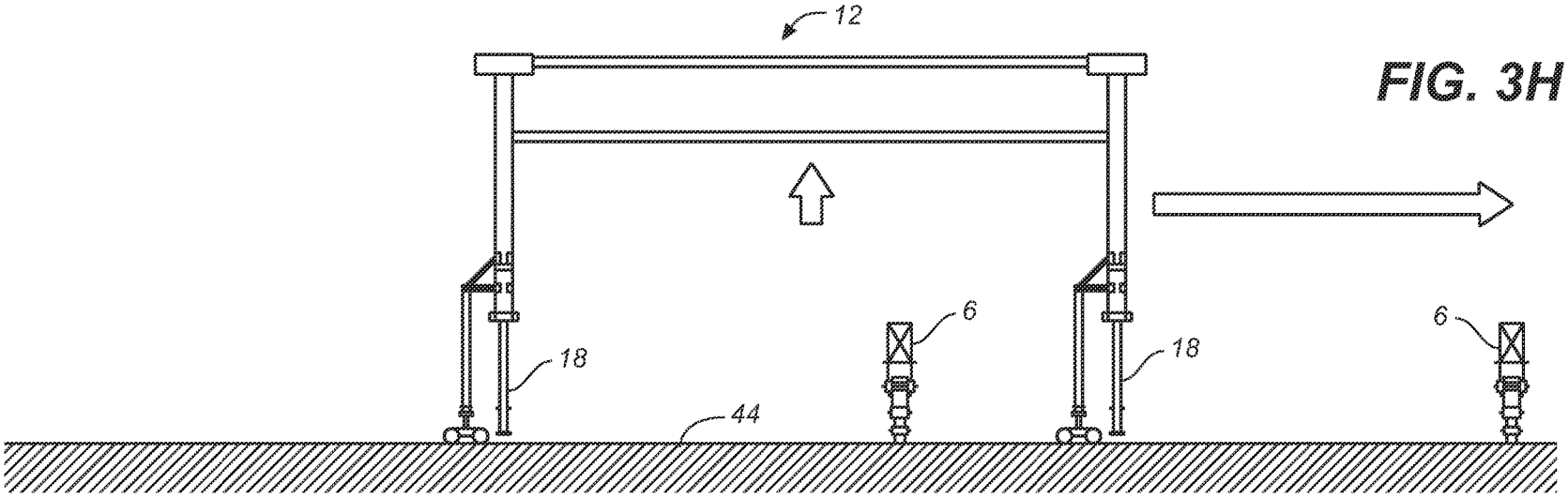
FIG. 3H is a side elevation view showing the legs of the jacking tower and the free-standing supports having been elevated.
Figure 3I:
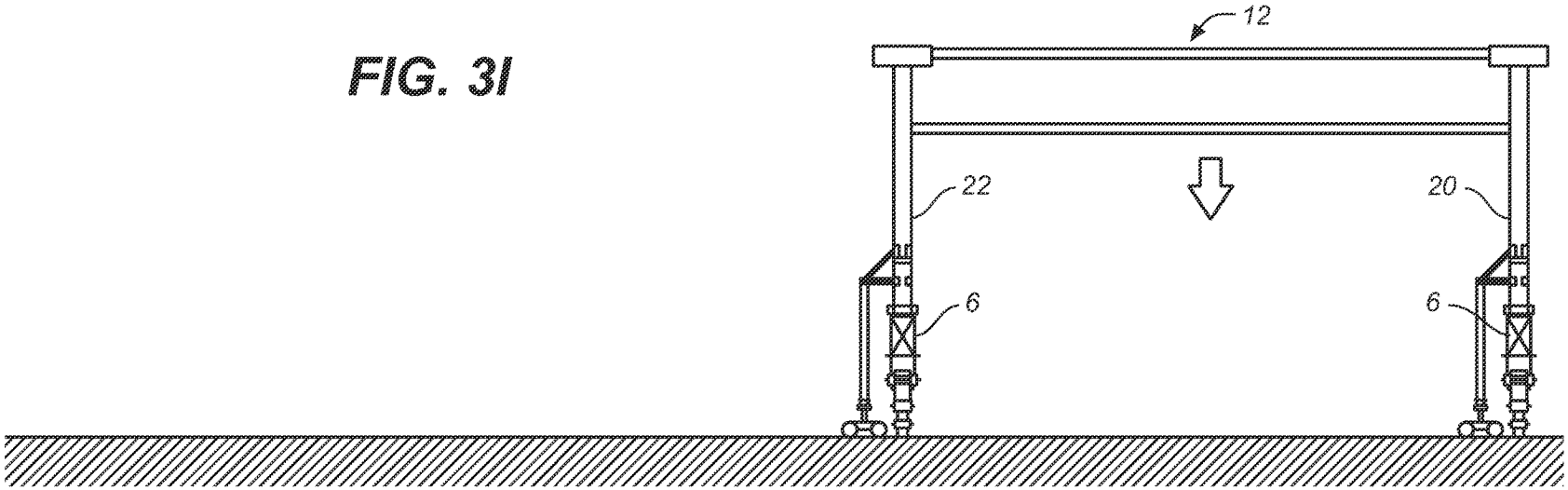
FIG. 3I is a side elevation view showing that the free-standing supports have been removed and the legs of the jacking tower moved in position over the sill beams of the crane.

The jacking tower 12 is the raised until the temporary supports 18 are freed from the ground 44 as shown in FIG. 3H. The temporary supports 18 are then removed from the legs 20, 22 and the jacking tower is rolled forward until the legs 20, 22 are positioned over and in vertical alignment with the sill beams 6 of the crane 4 as shown in FIG. 3I.

Figure 3J:
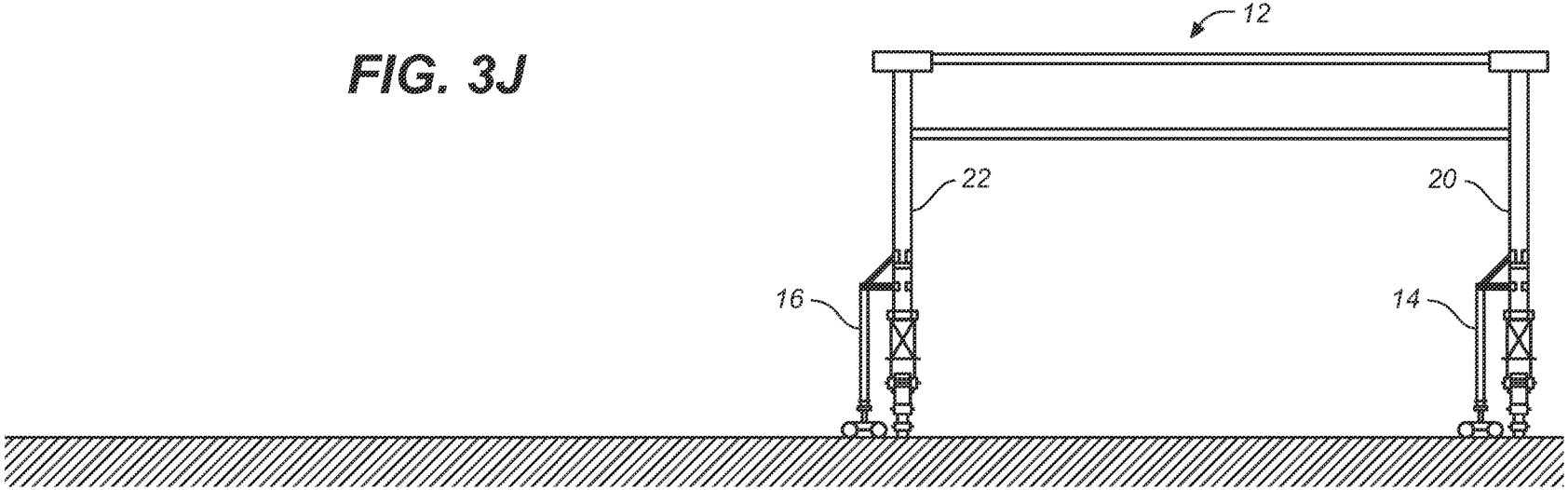
FIG. 3J is a side elevation view showing the legs of the jacking tower lowered onto the sill beams of the crane.

The jacking tower 12 is then lowered onto the sill beams 6 as shown in FIG. 3J, and the legs secured to the sill beams 6 as needed.

Figure 3K:
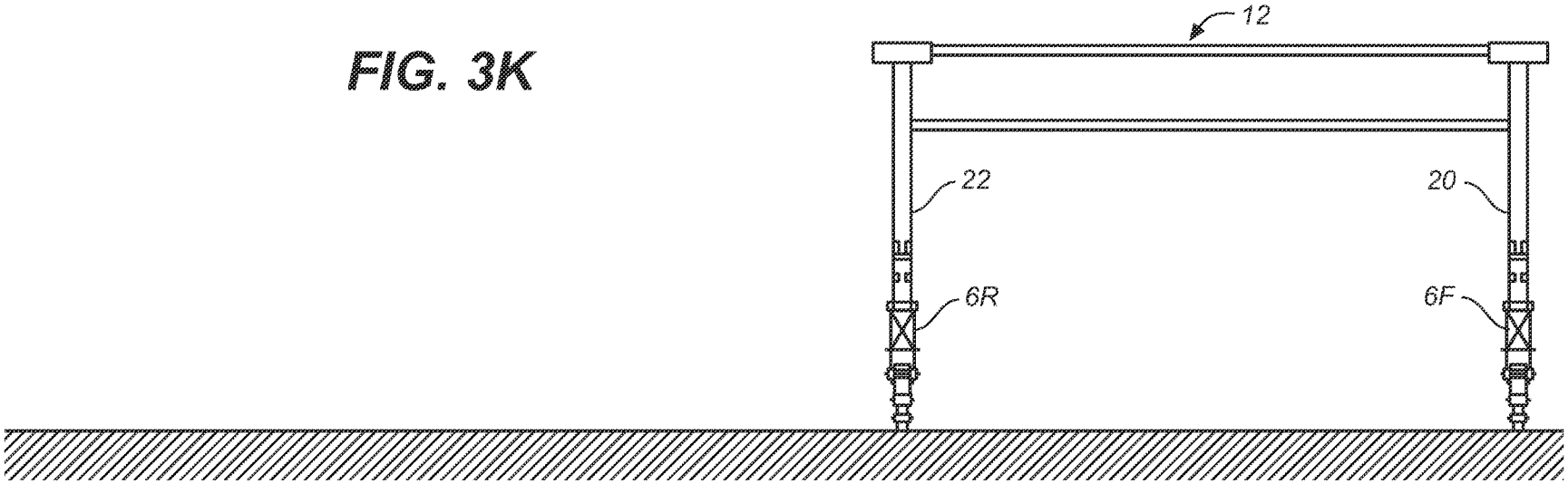
FIG. 3K is a side elevation view showing the jacking tower supported on the sill beams of the crane and the free-standing supports removed.

Finally, with the jacking tower 12 fully supported on the crane's sill beams 6, the support stands 14, 16 can be removed as shown in FIG. 3K.

Removal of the jacking tower 12 from the crane 4 is accomplished by reversing the above steps.

Installing a jacking tower on a cargo container crane according to the jacking tower installation system is cost-effective and time-efficient.

There have thus been described and illustrated certain embodiments of a jacking tower installation system according to the invention. Although the present invention has been described and illustrated in detail, it should be clearly understood that the disclosure is illustrative only and is not to be taken as limiting, the spirit and scope of the invention being limited only by the terms of the appended claims and their legal equivalents.

We claim:

1. A jacking tower installation system for installing a jacking tower on a container crane for increasing the height of the crane, the container crane having two spaced apart parallel sill beams defining a sill beam separation distance, the upper surfaces of the sill beams defining a sill beam level, the jacking tower installation system comprising:

a jacking tower having at least two forward legs, at least two rear legs, at least two forward footings and at least two rear footings, each of said at least two forward legs supported on one of said forward footings, each of said at least two rear legs supported on one of said rear footings, each of said forward and rear footings having an engagement portion for resting on one of the sill beams, the engagement portions of said forward footings and of said rear footings spaced apart by a distance equivalent to said sill beam separation distance, and a plurality of support stands, each support stand supporting at least one of said legs and horizontally offset from the engagement portion of the footing supporting said at least one leg, said plurality of support stands including lifts capable of raising said legs above the sill beam level, wherein said jacking tower is movable horizontally on said plurality of support stands.

2. The jacking tower installation system of claim 1 wherein:

each of said plurality of support stands is detachably attached to one of said legs.

3. The jacking tower installation system of claim 1 wherein:

said jacking tower is movable between single beam, reconfiguration, and dual beam positions, in said single beam position, said forward legs are disposed over one of the sill beams and said rear legs are horizontally spaced from both of the sill beams, in said reconfiguration position, said forward legs are positioned between the sill beams, and in said dual beam position, said forward legs are disposed over one of the sill beams and said rear legs are disposed over the other of the sill beams.

4. The jacking tower installation system of claim 3 further comprising:

an elevated state in which said legs are raised above the sill beam level, a beam supported state in which one or more of said legs are supported on one of the sill beams, and an intermediate support state in which said forward legs are supported on free-standing supports, each of said forward and rear legs having an outer side facing away from said jacking tower and an inner side opposite said outer side, said plurality of support stands being selectively attachable to said legs in first and second configurations, wherein in said first configuration one of said support stands is attached to the outer side of each of said rear legs, and one of said support stands is attached to the inner side of each of the forward legs, and in said second configuration one of said support stands is attached to the outer side of each of said forward and rear legs, wherein, in said single beam position said support stands are capable of being reconfigured from said first configuration to said second configuration while said forward legs are in said beam supported state, and in said reconfiguration position said support stands are capable of being reconfigured from said second configuration to said first configuration while in said intermediate support state.

5. The jacking tower installation system of claim 1 wherein:

each of said forward and rear legs has an outer side facing away from said jacking tower and an inner side opposite said outer side, and said plurality of support stands are selectively attachable to said legs in first and second configurations, wherein in said first configuration one of said support stands is attached to the outer side of each of said rear legs, and one of said support stands is attached to the inner side of each of the forward legs, and in said second configuration one of said support stands is attached to the outer side of each of said forward and rear legs.

6. The jacking tower installation system of claim 1 further comprising:

said plurality of support stands includes a plurality of lifts capable of raising and lowering said legs.

7. The jacking tower installation system of claim 6 further comprising:

an elevated state in which said legs are elevated above the sill beam level, a beam supported state in which one or more of said legs are supported on one of the sill beams, and an intermediate support state in which said forward legs are supported on free-standing free-standing supports.

8. The jacking tower installation system of claim 7 wherein:

said jacking tower is movable between single beam, reconfiguration, and dual beam positions, in said single beam and reconfiguration positions said forward legs are movable between said elevated and beam supported states, in said dual beam position said forward and rear legs are moveable over said sill beams between said elevated and beam supported states.

9. The jacking tower installation system of claim 1 further comprising:

a plurality of free-standing supports each in vertical alignment with said legs, said free-standing supports capable of supporting said at least two forward legs between the sill beams.

10. The jacking tower installation system of claim 9 further comprising:

a plurality of stabilizing braces each detachably secured to one of said free-standing supports and one of said support stands.

11. The jacking tower installation system of claim 1 further comprising:

each of said plurality of support stands including an offset bracket, a support column and a dolly, said offset bracket supported on said column and said column supported on said dolly, said offset bracket removably attached to one of said legs such that said column is horizontally offset from said leg, said platform movable horizontally on the dollies of said plurality of support stands.

12. A jacking tower installation system for installing a jacking tower on a container crane for increasing the height of the crane, the container crane having two spaced apart parallel sill beams defining a sill beam separation distance, the upper surfaces of the sill beams defining a sill beam level, the jacking tower installation system comprising:

a jacking tower having at least two forward legs and at least two rear legs, said forward and rear legs spaced apart a distance equivalent to the sill beam separation distance, each of said legs having an outer side facing away from said jacking tower and an inner side opposite said outer side, and a plurality of support stands, each support stand including an offset bracket, a support column and a dolly, said offset bracket supported on said column and said column supported on said dolly, said offset bracket removably attached to one of said legs such that said column and said dolly are horizontally spaced from said leg, said legs supported on said plurality of support stands, the dollies of said plurality of support stands including a plurality of lifts capable of raising said legs to a selected level, said plurality of support stands having first and second configurations, in said first configuration the offset bracket of one of said plurality of support stands attached to the outer side of each of said rear legs, and the offset bracket of one of said plurality of support stands attached to the inner side of each of said forward legs, in said second configuration the offset bracket of one of said plurality of support stands attached to the outer side of each of said forward and rear legs, and a plurality of free-standing supports, said jacking tower movable on said dollies between single beam, reconfiguration, and dual beam positions, in said single beam position said forward legs are (a) disposed over one of the sill beams, and (b) selectively elevated above the sill beam level or supported on one of the sill beams, in said reconfiguration position said forward legs are (a) selectively disposed over said free-standing supports, and (b) selectively elevated above or supported on one of said free-standing supports, and in said dual beam position said forward and rear legs are (a) disposed over the sill beams, and (b) selectively elevated above the sill beam level or supported on the sill beams, and wherein, when said jacking tower is in said single beam position and said forward legs are supported on one of the sill beams, said plurality of support stands is capable of being arranged selectively in said first or second configurations, and when said jacking tower is in said reconfiguration position and said forward legs are supported on said free-standing supports, said plurality of support stands is capable of being arranged selectively in said first or second configurations.

13. The jacking tower installation system of claim 12 wherein:

said jacking tower is movable between said single beam and reconfiguration positions when said plurality of support stands is in said second configuration, and said jacking tower is movable between said reconfiguration and dual beam positions when said plurality of support stands is in said first configuration.

14. A method for installing a jacking tower on a container crane for increasing the height of the crane, the container crane having two spaced apart parallel sill beams defining a sill beam separation distance, the upper surfaces of the sill beams defining a sill beam level, in the following order the method comprising:

attaching a plurality of rear support stands to the outer sides of at least two rear legs of a jacking tower such that said rear support stands are horizontally spaced from said rear legs, attaching a plurality of forward support stands to the inner sides of at least two forward legs of said jacking tower such that said forward support stands are horizontally spaced from said forward legs, said at least two rear and said at least two forward legs spaced apart a distance equivalent to the sill beam separation distance, the outer side of each of said legs of said jacking tower facing away from said jacking tower, and the inner side of each of said legs opposite said outer side, supporting said legs above a ground surface on said support stands, elevating said legs above the sill beam level, moving said jacking tower on said plurality of support stands to position said at least two forward legs over one of the sill beams, lowering said legs until said at least two forward legs are supported on the sill beam, detaching said plurality of forward support stands from said at least two forward legs, attaching said plurality of forward support stands to the outer sides of said at least two forward legs, elevating said legs above the sill beam level.

15. The method for installing a jacking tower on a container crane of claim 14 in the following order further comprising:

moving said jacking tower on said plurality of support stands so that said at least two forward legs are positioned intermediate the sill beams over at least two free-standing supports, lowering said legs until said at least two forward legs are supported on said at least two free-standing supports, detaching said plurality of forward support stands from said at least two forward legs, attaching said plurality of forward support stands to the inner sides of said at least two forward legs elevating said legs above the sill beam level, removing said at least two free-standing supports, moving said jacking tower to a position in which said at least two forward legs are disposed over one of the sill beams and said at least two rear legs are disposed over the other of the sill beams, and lowering said legs until said at least two forward legs are supported on one of the sill beams and said at least two rear legs are supported on the other of the sill beams.

* * * * *